US007000917B2

(12) United States Patent
Helmstädter et al.

(10) Patent No.: US 7,000,917 B2
(45) Date of Patent: Feb. 21, 2006

(54) SHEET-GUIDING DEVICE IN A SHEET-PROCESSING MACHINE

(75) Inventors: Karl-Heinz Helmstädter, Heidelberg (DE); Thorsten Eckart, Ilvesheim (DE); Peter Hachmann, Dossenheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 174 days.

(21) Appl. No.: 10/412,835

(22) Filed: Apr. 14, 2003

(65) Prior Publication Data

US 2003/0222390 A1 Dec. 4, 2003

(30) Foreign Application Priority Data

Apr. 12, 2002 (DE) ..... 102 16 387

(51) Int. Cl.
*B65H 5/02* (2006.01)

(52) U.S. Cl. ..... 271/276; 271/277; 101/230

(58) Field of Classification Search ..... 271/275, 271/276, 277; 101/230, 232, 408, 409
See application file for complete search history.

(56) References Cited

U.S. PATENT DOCUMENTS 3,727,912 A * 4/1973 Vos ..... 271/276
3,986,455 A * 10/1976 Jeschke et al. ..... 101/409
4,060,238 A * 11/1977 Simeth ..... 271/276
4,186,662 A * 2/1980 Borneman ..... 101/218
4,384,524 A * 5/1983 Simeth et al. ..... 101/232
4,395,949 A * 8/1983 Jeschke ..... 101/420
4,413,562 A * 11/1983 Fischer ..... 101/408
4,869,166 A * 9/1989 Mathes ..... 101/230
4,930,414 A * 6/1990 Wirz ..... 101/183
5,086,698 A * 2/1992 Wirz ..... 101/409
5,156,090 A * 10/1992 Wirz ..... 101/142
5,271,323 A * 12/1993 Munker ..... 101/409
5,398,925 A * 3/1995 Zeltner ..... 271/276
5,609,103 A * 3/1997 Stephan et al. ..... 101/230
5,655,449 A * 8/1997 Henn et al. ..... 101/232
5,687,964 A 11/1997 Stephan et al.

(Continued)

FOREIGN PATENT DOCUMENTS

DE 43 42 203 A1 6/1995

(Continued)

*Primary Examiner*—Donald P. Walsh
*Assistant Examiner*—Matthew J. Kohner
(74) *Attorney, Agent, or Firm*—Laurence A. Greenberg; Werner H. Stemer; Ralph E. Locher

(57) ABSTRACT

A sheet-guiding device in a sheet-processing machine, in particular a sheet-fed rotary printing press, includes gripper devices disposed on revolving components of the sheet-processing machine for guiding the sheets to be printed on an air cushion formed by blast air. A multiplicity of free jet nozzles, disposed radially outside a path of movement of the gripper devices, form the air cushion. The free jet nozzles serve for producing free air jets tangentially delimiting an optimized path of movement of the sheets. The optimized path of movement extends in the vicinity of the path of movement of the gripper devices.

19 Claims, 5 Drawing Sheets

U.S. PATENT DOCUMENTS

| | | | | | |
|---|---|---|---|---|---|
| 5,701,819 | A | * | 12/1997 | Stephan | 101/409 |
| 5,706,726 | A | * | 1/1998 | Stephan | 101/232 |
| 5,913,268 | A | * | 6/1999 | Jackson et al. | 101/420 |
| 5,979,318 | A | * | 11/1999 | Helmstadter | 101/232 |
| 6,089,156 | A | * | 7/2000 | Stephan | 101/230 |
| 6,470,798 | B1 | * | 10/2002 | Hiwatashi et al. | 101/231 |
| 6,477,951 | B1 | * | 11/2002 | Fujimoto | 101/232 |
| 6,561,508 | B1 | * | 5/2003 | Helmstadter et al. | 271/226 |
| 6,572,095 | B1 | * | 6/2003 | Katou et al. | 271/3.22 |
| 6,598,874 | B1 | * | 7/2003 | Hachmann et al. | 271/276 |
| 6,619,201 | B1 | * | 9/2003 | Becker et al. | 101/230 |
| 6,626,109 | B1 | * | 9/2003 | Kundgen et al. | 101/477 |
| 6,640,707 | B1 | * | 11/2003 | Frankenberger et al. | 101/232 |
| 6,662,722 | B1 | * | 12/2003 | Frankenberger et al. | 101/232 |
| 6,681,696 | B1 | * | 1/2004 | Stephan | 101/231 |
| 6,722,276 | B1 | * | 4/2004 | Helmstadter | 101/230 |
| 6,722,652 | B1 | * | 4/2004 | Kobayashi et al. | 271/276 |

FOREIGN PATENT DOCUMENTS

| | | | |
|---|---|---|---|
| DE | 44 27 448 | A1 | 2/1996 |
| DE | 196 38 311 | A1 | 5/1997 |
| DE | 195 47 580 | C2 | 6/1997 |
| DE | 197 53 089 | A1 | 6/1999 |
| DE | 100 11 436 | A1 | 11/2000 |
| DE | 101 02 733 | A1 | 8/2001 |

* cited by examiner

SHEET-GUIDING DEVICE IN A SHEET-PROCESSING MACHINE

BACKGROUND OF THE INVENTION

Field of the Inventiion

The invention relates to a sheet-guiding device in a sheet-processing machine, in particular a sheet-fed rotary printing press. The device has gripper devices provided on revolving components of the sheet-processing machine for guiding the sheets on an air cushion formed by blast air.

In sheet-fed rotary presses, the paper sheets to be printed are removed from a sheet pile and transported through individual printing units of the printing press by grippers provided on rotating cylinders. The printing units serve for printing the sheets with one, two or more colors in respective printing nips thereof. The printing nips are respectively formed by the blanket cylinders, which transfer the printing images for the individual colors, and by the respective impression cylinders which are set against the blanket cylinders with great pressure.

The guidance of the sheets during the transport thereof through the sheet-fed rotary printing machine is performed in a region underneath the transfer cylinders or transfer drums, and if a reversing or turning device is used, by which the sheets are temporarily stored on a storage drum, underneath the storage drum, by respective pneumatic sheet-guiding devices. The sheet-guiding devices are formed of at least approximately planar guide plates, which are disposed at a spaced distance from the path of movement of the gripper devices of the drums and/or cylinders, and which are equipped with a large number of slit nozzles or air jets. Blast air emerging from the air jets at least approximately tangentially to the surface of the guiding devices, in that regard, produces a carrying air cushion which holds the respective sheet at a well-defined spaced distance above the guide surface.

A device of that type has been disclosed, for example, in German, Published, Non-prosecuted Patent Application DE 44 27 448 A1, corresponding to U.S. Pat. No. 5,687,964. In the case of that heretofore known device, a problem occurs in that the guide plates with the slit nozzles or air jets provided therein have to be disposed at a distance from the circular path of movement of the gripper devices in order to preclude a collision with the gripper devices. As a consequence of an omission of or failure to include remote action or effect of the slit nozzles or air jets from which the blast air flows for producing a well-defined air cushion to support the sheets at least approximately tangentially to the guide surface, the sheets, during the transport thereof over the guide surfaces, are not transported on an optimal path of movement, but rather, on a radially farther outward-lying path.

Due to the deviation of the actual path of movement of the sheets from the optimal radially farther inward-lying path of movement, undesired disturbances during sheet movement occur, in particular at high continuous or production printing speeds. That can lead to considerable losses in quality in the printed image.

Thus, it is observed in practice that, in recto and verso printing, contact of the guide plate with the freshly printed outer sides of the sheets can occur after turning or reversing, when lightweight to medium-weight papers are used. That is because the sheets are sucked onto the guide plate due to the high relative speed between those sheets and the guide plate, and due to the rather slight spacing between the guide plate and the sheet, a phenomenon which is attributable to the so-called1 "Bernoulli effect".

The sheet is thereby guided on a circular path which extends radially outside the ideal path of movement, as a result of which a disruptive effect called "sheet pushing or sliding" occurs during the transfer of the leading edge of the sheet from a transfer drum to the gripper devices of the impression cylinder disposed downstream from the transfer drum. That disruptive effect can be attributed to the fact that the speed of the sheet on the radially outward-lying path of movement is greater than the speed of the gripper devices of the impression cylinder, which hold the leading edge of the sheet, due to which the rear or trailing part of the sheet must be braked in the region before the printing nip, and therefore leads to pushing or sliding of the sheets before the printing nip.

In order to counteract that disruptive effect, in conventional printing presses, blast air is frequently applied to the impression cylinders in the region before the printing nip. However, that often does not completely eliminate or eradicate the effect and moreover leads to increased energy consumption.

Furthermore, it has become known heretofore from German Published, Non-prosecuted Patent Application DE 43 42 203 A1 to place a suction box below a transfer drum and to have the suction box suck the unprinted sides of the sheets against and onto the sheet-guiding surface of the suction box during a recto printing operation in order to tauten the sheets and to reduce the "pushing or sliding" action on the sheets. In addition, with regard to the device described in the aforementioned German Published, Non-prosecuted Patent Application DE 43 42 203 A1, the sheets are guided on a path lying radially outside the optimal movement path, due to which the aforementioned problems occur. Additionally, smear-free sheet guidance is not possible during recto and verso printing in the case of the device described in the German patent application because, in that case, the freshly printed sheet underside would be guided along directly on the guide surface of the suction box.

SUMMARY OF THE INVENTION

It is accordingly an object of the invention to provide a sheet-guiding device in a sheet-processing machine, which overcomes the hereinafore-mentioned disadvantages of the heretofore-known devices of this general type, which permits sheet movement that is optimized in comparison with that for the prior art and which, in particular, prevents the sheets from being smeared in the region of the transfer drums disposed between two printing units and also prevents the sheets from being "pushed or slid" in the entry region of the impression cylinders.

With the foregoing and other objects in view, there is provided, in accordance with the invention, a sheet-guiding device in a sheet-processing machine, in particular a sheet-fed rotary printing press, comprising gripper devices disposed on revolving components of the sheet-processing machine for guiding the sheets to be printed, on an air cushion formed by blast air, and a multiplicity of free jet nozzles, disposed radially outside a path of movement of the gripper devices, for forming the air cushion. The free jet nozzles serve for producing free air jets tangentially delimiting an optimized path of movement for the sheets. The optimized path of movement extends in the vicinity of the path of movement of the gripper devices.

In accordance with another feature of the invention, the optimized path of movement of the sheets extends along a circular path over which the gripper devices are sweepable.

In accordance with a further feature of the invention, the optimized path of movement of the sheets extends radially within the circular path over which the gripper devices are sweepable.

In accordance with an added feature of the invention, the free jet nozzles serve for producing conical and/or wedge-shaped free air jets.

In accordance with an additional feature of the invention, the free jet nozzles are formed by a multiplicity of blast tubes extending transversely to the sheet transport direction. The blast tubes respectively have a plurality of mutually adjacent nozzle openings formed therein and serve for emitting the free air jets therefrom.

In accordance with yet another feature of the invention, the nozzle openings of respective blast tubes are disposed offset from nozzle openings of respective adjacent blast tubes.

In accordance with yet a further feature of the invention, the blast tubes are disposed along the optimized path of movement of the sheets at least at approximately equal distances from one another.

In accordance with yet an added feature of the invention, the free jet nozzles are made up of a multiplicity of individual blast tubes respectively formed with a nozzle opening from which an individual free air jet is able to emerge.

In accordance with yet an additional feature of the invention, the individual blast tubes respectively have a curved air outlet connecting piece, from an end of which the free air jets are respectively able to emerge.

In accordance with still another feature of the invention, an alignment of the air outlet connecting pieces with respect to the optimized path of movement of the sheets is individually variable.

In accordance with still a further feature of the invention, the sheet-guiding device further includes vertical air guiding elements for laterally delimiting the free air jets. The vertical air guiding elements are disposed at least approximately vertically with respect to the optimized path of movement of the sheets.

In accordance with still an added feature of the invention, the sheet-guiding device further includes horizontal air guiding elements for delimiting the free air jets in horizontal direction. The horizontal air guiding elements are disposed transversely to the sheet transport direction, between the optimized path of movement of the sheets and the free jet nozzles.

In accordance with still an additional feature of the invention, the free jet nozzles are formed by a multiplicity of blast tubes extending transversely to the sheet transport direction. The horizontal air guiding plates are secured directly to the blast tubes.

In accordance with another feature of the invention, the horizontal air guiding plates are adjustable in position.

In accordance with a further feature of the invention, the vertical air guiding plates are adjustable in position.

In accordance with an added feature of the invention, the free air jets extend in a blowing direction counter to a transport direction of the sheets.

In accordance with an additional feature of the invention, at least part of the free air jets extend in a lateral or an oblique direction with respect to a sheet transport direction.

In accordance with a concomitant feature of the invention, the sheet-processing machine is a sheet-fed rotary printing press.

Thus, according to the invention, there is provided a pneumatic sheet-guiding device in a sheet-processing machine, wherein leading edges of sheets are guided by gripper devices, on an air cushion produced by blown or blast air. The air cushion is produced by a large number of free jet nozzles disposed fixed to a frame radially outside a path of movement of the gripper devices. The gripper devices are attached to rotating components of the printing press, in particular to transfer cylinders or transfer drums and to storage drums of reversing or turning devices. The gripper devices hold the leading edges of the sheets while the sheets are being transported through the printing press.

The free air jets are preferably aligned in such a way that they tangentially delimit the theoretically optimal path of movement of the sheets, which is sometimes referred to below as the optimized movement path of the sheets. In other words, the optimized movement path is set by a large number of free air jets. Each individual free air jet tangentially intersects the optimized movement path.

The result of this is an actual movement path of the sheets which is approximated to the optimized movement path for the sheets and having a coincidence with the theoretically optimal movement path which is all the greater the more free air jets are used.

In this regard, the optimized movement path as a rule corresponds to the circular path which is swept over by the gripper devices during a rotation of the transfer drum. However, the optimized movement path can, if desired, also extend radially further inside the circular path swept over by the gripper devices, for example, in order to tauten the sheets on the circumferential surface of the impression cylinder disposed downstream, after the sheets have been accepted by the gripper devices of the impression cylinder so as in this way to prevent or at least reduce "pushing or sliding" of the sheets.

In a preferred embodiment of the invention, the free jet nozzles are formed by openings which preferably produce conical free air jets.

In this regard, the free jet nozzles can, for example, be formed by a large number of blast tubes extending transversely with respect to the sheet transport direction, the blast tubes, respectively, being formed with a plurality of mutually adjacent nozzle openings from which the free air jets emerge.

In this regard, the blast tubes are preferably disposed along the optimized movement path of the sheets at least at approximately equal distances from one another, each of the blast tubes preferably being at the same predetermined and optionally adjustable distance from the optimized movement path of the sheets.

According to another embodiment of the invention, it is possible for the free air jets to be formed by a large number of individual blast tubes which are disposed in the vicinity of the transfer drum or of the storage drum. In this regard, each of the individual blast tubes is formed with a nozzle opening from which an individual free air jet emerges.

Furthermore, the individual blast tubes, respectively, have a curved air outlet connecting piece, from an end of which the free air jets emerge. The air can be supplied via a common distributor, for example in the form of a box. The curvature results in a particularly compact construction of the device in three-dimensional terms. In addition, a movable configuration of the curved air outlet connecting pieces and/or of the individual blast tubes offers the advantage that the individual blast tubes can be rotated and/or pivoted if desired, in order to align the blowing or blast direction of the free air jets, for example in the vicinity of the side edges of the sheets, towards the side edges, so that lateral sheet tautening is attained.

In order to make an-alignment of the air outlet connecting pieces individually variable with respect to the optimized movement path of the sheets, the air outlet connecting pieces can be connected, for example, by universal joint connections, to parts of the printing press fixed to the frame, for example, a crossmember, the universal joints permitting simultaneous rotation and also pivoting or swiveling of the air outlet connecting pieces.

According to a further embodiment of the invention, air guiding elements aligned vertically with respect to the sheet transport direction can be disposed to the side of each of the free jet nozzles, the angle of the air guiding elements preferably being adjustable with respect to the associated outflow axis of the nozzle in order to form the opening or aperture angle of the free air jets so that it is variable transversely with respect to the sheet transport direction.

In the same manner, horizontal air guiding plates may be provided transversely with respect to the sheet running or transport direction between the optimized movement path for the sheets and the free jet nozzles, the air guiding plates delimiting, preferably likewise in an adjustable manner, the edge of the free air jets in the horizontal direction so that the optimized movement path is at least approximately engaged tangentially by the free air jets.

In the preferred embodiment of the invention, the horizontal air guiding plates are, in this regard, preferably attached directly to the horizontally disposed blast tubes which extend transversely to the sheet transport direction or, in the case of individual blast tubes, are attached in the vicinity of the curved section, the attaching member preferably likewise being articulated in order for it to be possible to change the opening angle of the free air jets in the vertical direction.

According to a further embodiment of the invention, the blowing or blast direction of the free air jets extends counter to the transport direction of the sheets, as a result of which additional tautening of the sheets occurs and, in the case of light materials, the risk of the sheets colliding due to gravity is reduced after the sheet leading edge has been transferred from an impression cylinder disposed upstream to a transfer drum disposed downstream.

In the same manner, however, provision can likewise be made for at least part of the free air jets to be aligned laterally or obliquely with respect to the sheet transfer direction in order to achieve further lateral tautening of the sheets during the transport thereof on the air cushion produced in accordance with the invention.

Other features which are considered as characteristic for the invention are set forth in the appended claims.

Although the invention is illustrated and described herein as embodied in a sheet-guiding device in a sheet-processing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
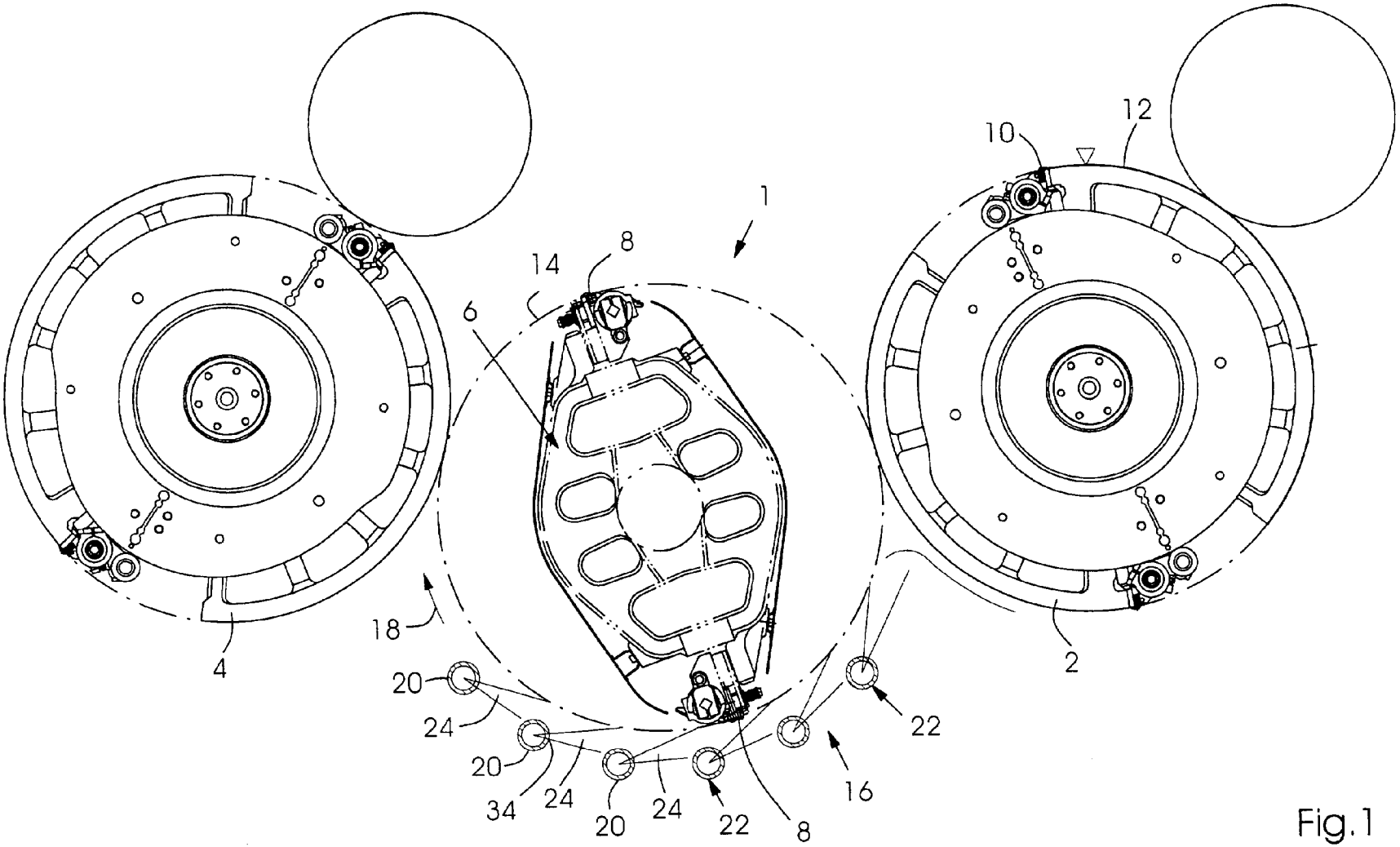
FIG. 1 is a diagrammatic, side-elevational view of a sheet-fed rotary printing press having a sheet-guiding device according to the invention which is disposed underneath a transfer drum and is provided with transversely extending blast tubes.

Referring now in detail to the figures of the drawing and first, particularly, to FIG. 1 thereof, there is seen a sheet-processing machine 1 which, in this case, is a sheet-fed rotary printing press, including an upstream impression cylinder 2, as viewed in a sheet transport path, with respect to an impression cylinder 4 disposed downstream from the impression cylinder 2. A transfer drum 6 with gripper devices 8 is disposed between the impression cylinders 2 and 4 in the sheet transport path. The gripper devices 8 accept the leading edge of sheets 12, which are guided on the upstream impression cylinder 2 by a gripper device 10 disposed on the latter, and transfer the sheets 12 in a conventional manner to the gripper devices of the impression cylinder 4 which is disposed downstream. In this process, the gripper devices 8 of the transfer drum 6 move along a circular path 14 which will also be referred to below as the optimized movement path 14.

A sheet-guiding device 16 according to the invention is disposed underneath the transfer drum 6, and is provided with blast tubes 20 which extend transversely to the sheet transport direction represented by an arrow 18. The blast tubes 20 form free jet nozzles which produce at least approximately conical free air jets 24.

Figure 2:
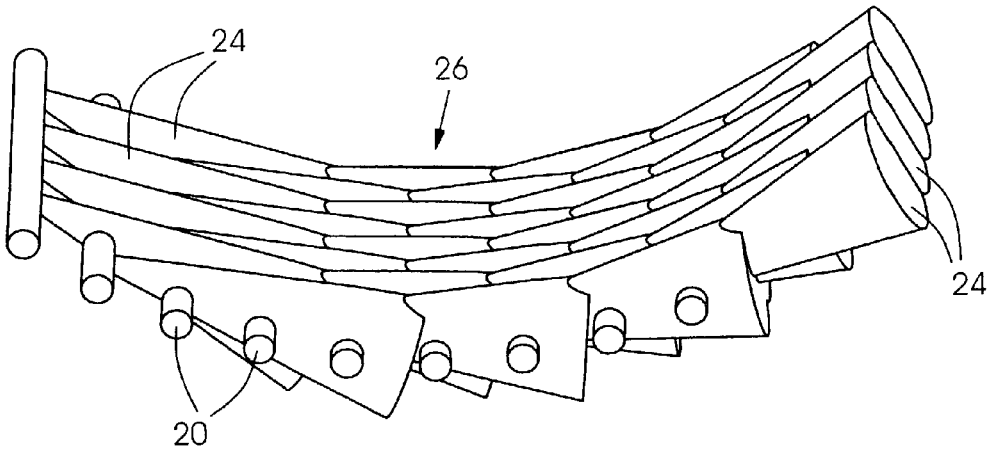
FIG. 2 is a fragmentary, side, top and end perspective view of FIG. 1, showing a multiplicity of conical free air jets for forming an air cushion in accordance with the invention, for guiding the sheets on a path of movement at least approximately similar to an optimal path of movement.
Figure 3:
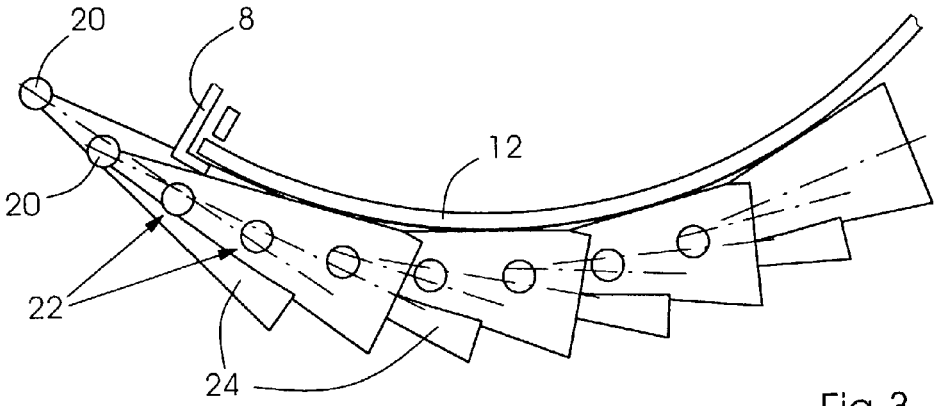
FIG. 3 is a side-elevational view of FIG. 2 illustrating the free air jets thereof with the appertaining free jet nozzles.

As illustrated in FIGS. 2 and 3, the conical free air jets 24 are aligned in such a way that they tangentially intersect the optimized path 14 of movement of the sheets 12 and, due to the offset of the individual free air jets 24 of two adjacent blast tubes 20 in the transverse direction, create an air cushion 26 which guides the sheets 12 on a path approximated to the optimized path 14 of movement.

Figure 4:
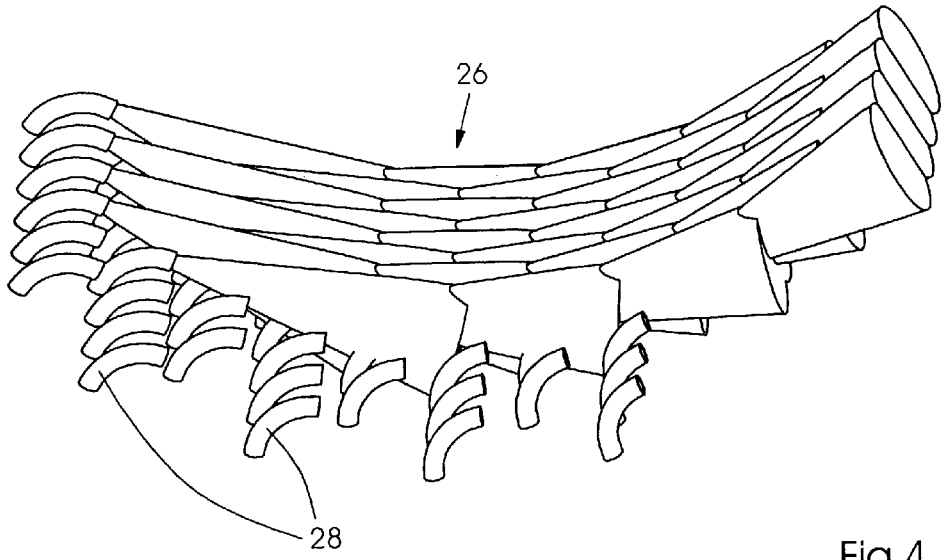
FIG. 4 is a view similar to that of FIG. 2 illustrating, in a perspective view, an air cushion which is composed of conical free air jets produced from a multiplicity of individual blast tubes with a curved air outlet nozzle or connecting piece.
Figure 5:
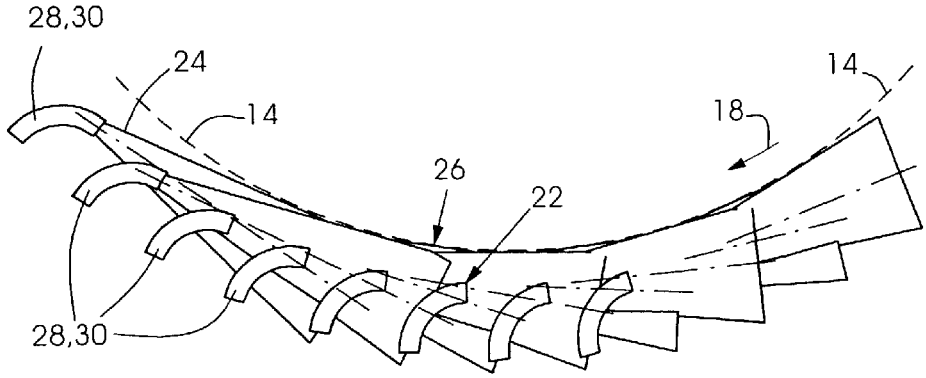
FIG. 5 is a view similar to that of FIG. 3 illustrating the air cushion from FIG. 4.

According to FIGS. 4 and 5, in a further embodiment of the invention, the air cushion 26 is formed by free air jets 24 which are produced by free jet nozzles in the form of individual blast tubes 28. The individual blast tubes 28 preferably have curved air outlet connecting pieces 30, respectively, from the ends of which the free air jets 24 emerge. The curved air outlet connecting pieces 30 are preferably configured, in this regard, so as to as to be movable, with the result that it is possible to change the blowing or blast direction of the free air jets 24 in the lateral direction, and to change the inclination of the free air jets in a direction extending vertically to the transport direction 18 in order to obtain, as tangential as possible, an intersection of the free air jets 24 with the optimized movement path 14.

The gripper devices 8 and the transfer drum 6 are not shown in FIGS. 4 and 5 in the interest of maintaining clarity of the features illustrated therein.

Figure 6:
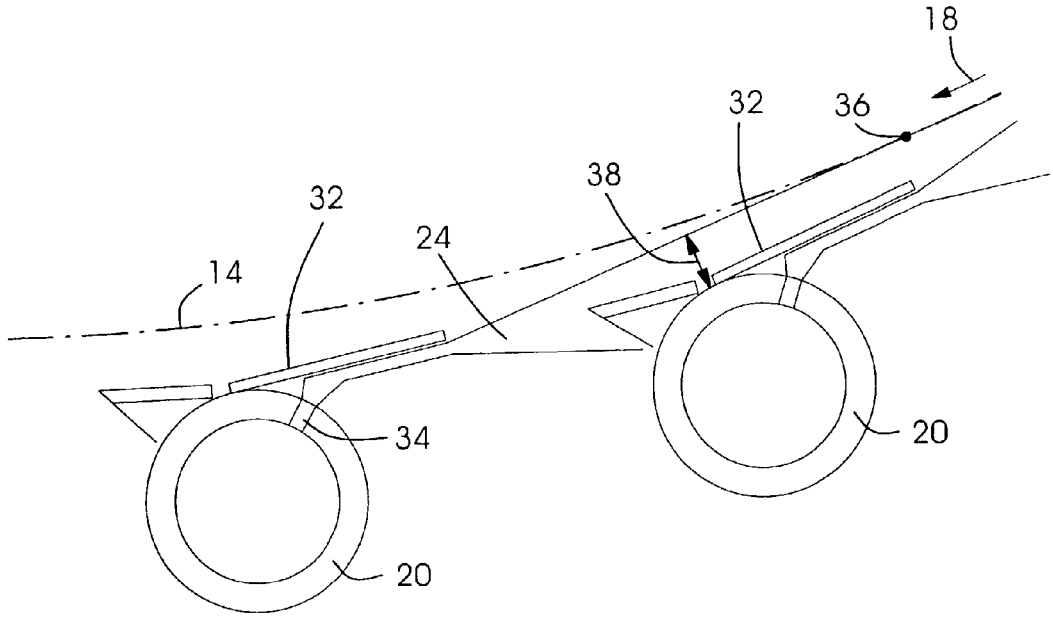
FIG. 6 is an enlarged, fragmentary view of FIG. 1 showing, in an end view, two blast tubes extending transversely to the sheet transport direction and equipped with a horizontal air guiding plate.

According to FIG. 6, the blast tubes 20 extending transversely to the sheet transport direction represented by the arrow 18 have horizontal air guiding elements 32 which are disposed between the optimized movement path 14 and the blast tubes 20. The blast tubes 20 extend transversely to the transport or running direction of the sheets and are preferably configured as plates or guide plates. The horizontal air guiding elements 32 delimit and guide, in this regard, the free air jets 24 emerging from the nozzle openings 34 of the blast tubes 20 to an extent that the free air jets 24 are approximately of wedge-shaped configuration and tangentially intersect the optimized movement path 14 at a point of tangency 36 in FIG. 6. A distance 38 between the optimized movement path 14 and the side of the horizontal air guiding elements 32 facing towards the optimized movement path 14 can be, for example, in the range of 5 to 35 mm.

Figure 7:
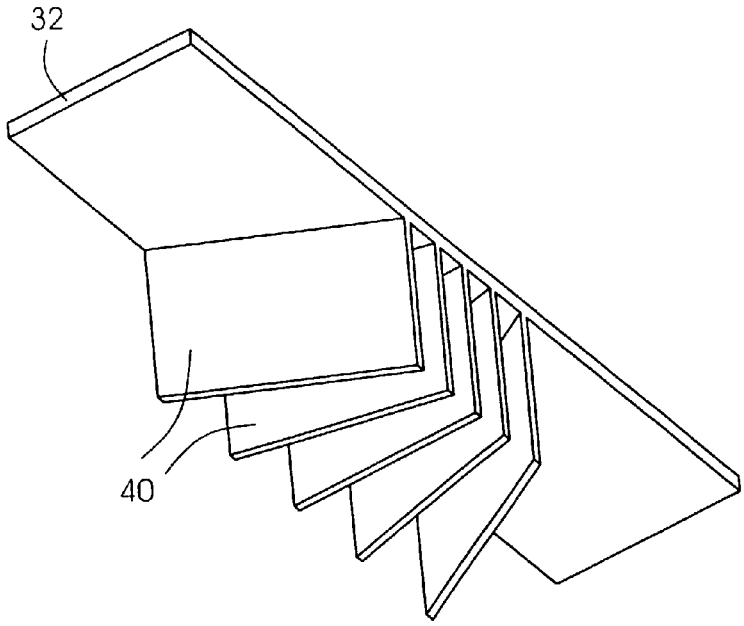
FIG. 7 is a side, end and bottom perspective view of a configuration of horizontally and vertically extending air guiding plates serving for laterally and vertically delimiting the free air jets emerging from the nozzle openings of the individual blast tubes or of the transversely extending blast tubes.

According to FIG. 7, vertical air guiding plates 40 are furthermore provided at least approximately vertically with respect to the optimized movement path 14 for the sheets 12, the air guiding plates 40 being disposed sidewise to the nozzle openings 34, and laterally delimiting the free air jets 24. The vertical air guiding plates 40 are preferably likewise adjustable via universal joints (not represented) with regard to the alignment thereof with respect to the central axes of the free air jets 24.

Figure 8:
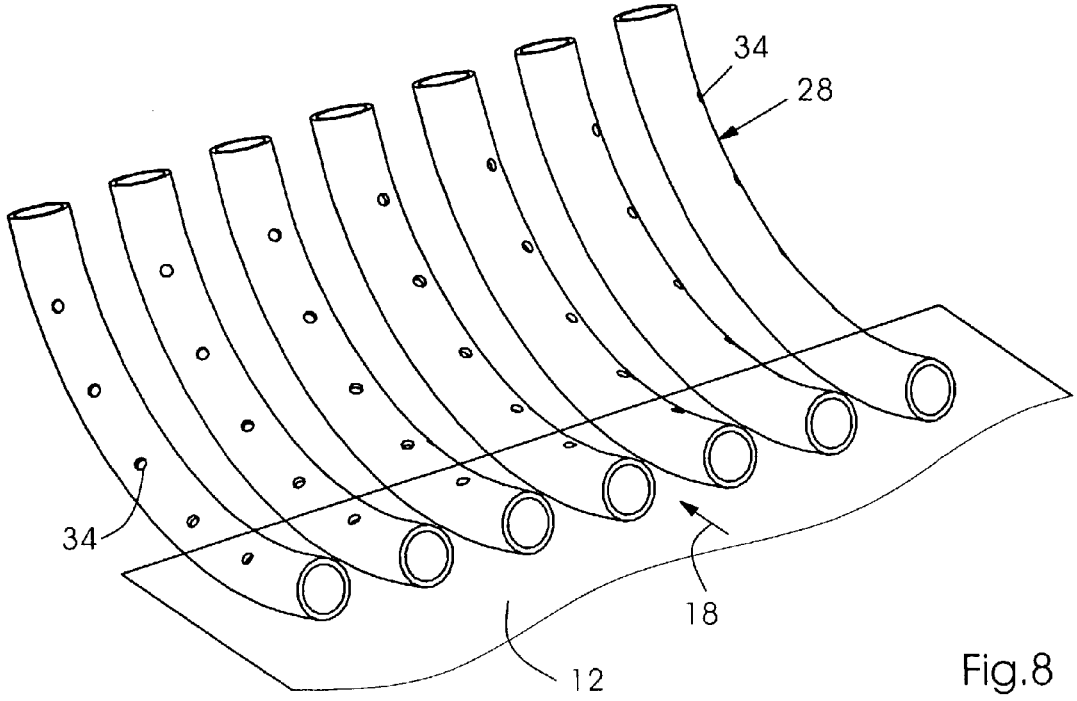
FIG. 8 is a top, side and end perspective view of another embodiment of blast tubes according to the invention for producing free air jets, having nozzle openings facing in different directions for producing free air jets having a blast or blowing direction extending towards the side edges of the sheets.

As shown in FIG. 8, the individual blast tubes 28 can furthermore be configured so that each individual blast tube 28 has a large number of nozzle openings 34 which are aligned so that the sheets 12 are guided on an air cushion 26 (not shown in FIG. 8) which, in addition to the free air jets 24 directed counter to the sheet transport direction 18, include free air jets aligned in a direction transverse thereto. The last-mentioned free air jets extending in the direction transverse to the sheet transport direction 18 likewise tangentially intersect the optimized movement path 14 in a manner according to the invention.

We claim:

1. A sheet-processing machine, comprising:

revolving components;

a sheet-guiding device disposed underneath said revolving components;

gripper devices disposed on said revolving components and following a path of movement for guiding sheets to be printed on an air cushion formed by blast air; and a multiplicity of free jet nozzles disposed radially outside said path of movement of said gripper devices for forming said air cushion, said free jet nozzles serving for producing free air jets tangentially to an optimized path of movement of the sheets, said free air jets extending in a blowing direction counter to a transport direction of the sheets, and said optimized path of movement extending in vicinity of said path of movement of said gripper devices.

2. The sheet-processing machine according to claim 1, wherein said optimized path of movement of the sheets extends along a circular path over which said gripper devices are to sweep.

3. The sheet-processing machine according to claim 1, wherein said optimized path of movement of the sheets extends radially within said circular path over which said gripper devices are to sweep.

4. The sheet-processing machine according to claim 1, wherein said free jet nozzles serve for producing at least one of conical and wedge-shaped free air jets.

5. The sheet-processing machine according to claim 1, wherein said free jet nozzles are formed by a multiplicity of blast tubes extending transversely to said sheet transport direction, said blast tubes each having a plurality of mutually adjacent nozzle openings formed therein for emitting said free air jets therefrom.

6. The sheet-processing machine according to claim 5, wherein said nozzle openings of respective blast tubes are disposed offset from nozzle openings of respective adjacent blast tubes.

7. The sheet-processing machine according to claim 5, wherein said blast tubes are disposed along said optimized path of movement of the sheets at least at approximately equal distances from one another.

8. The sheet-processing machine according to claim 1, wherein said free jet nozzles are made up of a multiplicity of individual blast tubes each formed with a nozzle opening from which an individual free air jet is to emerge.

9. The sheet-processing machine according to claim 8, wherein said individual blast tubes each have a curved air outlet connecting piece with an end from which said free air jets are to emerge.

10. The sheet-processing machine according to claim 9, wherein said air outlet connecting pieces are individually variably aligned with respect to said optimized path of movement of the sheets.

11. The sheet-processing machine according to claim 1, further comprising vertical air guiding elements for laterally delimiting said free air jets, said vertical air guiding elements being disposed substantially vertically with respect to a tangential line of said optimized path of movement of the sheets.

12. The sheet-processing machine according to claim 1, further comprising horizontal air guiding elements for delimiting said free air jets in horizontal direction, said horizontal air guiding elements being disposed transversely to said sheet transport direction, between said optimized path of movement of the sheets and said free jet nozzles.

13. The sheet-processing machine according to claim 12, wherein said free jet nozzles are formed by a multiplicity of blast tubes extending transversely to said sheet transport direction, said horizontal air guiding elements being secured directly to said blast tubes.

14. The sheet-processing machine according to claim 12, wherein said horizontal air guiding elements are adjustable in position.

15. The sheet-processing machine according to claim 11, wherein said vertical air guiding elements are adjustable in position.

16. The sheet-processing machine according to claim 1, wherein at least part of said free air jets extend in a lateral direction with respect to a sheet transport direction.

17. The sheet-processing machine according to claim 1, wherein at least part of said free air jets extend in an oblique direction with respect to a sheet transport direction.

18. The sheet-processing machine according to claim 1, wherein at least part of said free air jets extend in a lateral and an oblique direction with respect to a sheet transport direction.

19. The sheet-processing machine according to claim 1, wherein the sheet-processing machine is a sheet-fed rotary printing press.

* * * * *